United States Patent [19]

Hirohata et al.

[11] 4,002,786

[45] Jan. 11, 1977

[54] METHOD FOR ELECTROLESS COPPER PLATING

[75] Inventors: Hyogo Hirohata, Neyagawa; Masahiro Oita, Kashiwara; Katsuhiko Honjo, Kadoma, all of Japan

[73] Assignee: Matsushita Electric Industrial Co., Ltd., Osaka, Japan

[22] Filed: Apr. 18, 1975

[21] Appl. No.: 569,176

Related U.S. Application Data

[63] Continuation of Ser. No. 314,549, Dec. 13, 1972, abandoned, which is a continuation-in-part of Ser. No. 153,106, June 14, 1971, abandoned, which is a continuation-in-part of Ser. No. 767,502, Oct. 14, 1968, abandoned.

[30] Foreign Application Priority Data

Oct. 16, 1967 Japan ..... 42-67082
Oct. 27, 1967 Japan ..... 42-69769

[52] U.S. Cl. ..... 427/430 A; 427/305; 427/306; 106/1; 427/437

[51] Int. Cl.[2] ..... C23C 3/02

[58] Field of Search ..... 106/1; 427/98, 304, 427/306, 305

[56] References Cited

UNITED STATES PATENTS

| | | | |
|---|---|---|---|
| 3,377,174 | 4/1968 | Torigai | 106/1 |
| 3,649,350 | 3/1972 | Agens | 106/1 X |
| 3,650,777 | 3/1972 | Schneble | 106/1 |
| 3,754,940 | 8/1973 | Kadison | 106/1 |

*Primary Examiner*—Ralph S. Kendall
*Attorney, Agent, or Firm*—Wenderoth, Lind & Ponack

[57] ABSTRACT

This invention provides a method for electroless copper plating comprising: providing an electroless copper plating bath composition which comprises 0.005 to 0.3 mole per liter of a water soluble copper compound, 0.005 to 0.6 mole per liter of a cupric complexing agent, 0.02 to 3.0 mole per liter of formaldehyde, 0.01 to 1000 milligram per liter of additive agent selected from the group consisting of 2,2′-dipyridyl, 2,9-dimethyl-1,10-phenanthroline and 2-(2-phridyl)-benzimidazole, and alkaline compound to hold the pH of said aqueous solution 10.5 to 14 and immersing a material having catalytic action at the surface into said electroless copper plating bath composition kept at a temperature of 70° to 90° C whereby copper film with a high mechanical strength is deposited on said material.

6 Claims, No Drawings

METHOD FOR ELECTROLESS COPPER PLATING

This application is a continuation of application Ser. No. 314,549, filed Dec. 13, 1972, which in turn is a continuation-in-part of applicants' application Ser. No. 153,106 filed June 14, 1971, which is a continuation-in-part of Applicants' application Ser. No. 767,502, filed on Oct. 14, 1968, all now abandoned.

This invention relates to a method for electroless copper plating.

There have been known various method for electroless copper plating. A fundamental principle is that a material to be plated is dipped into an aqueous solution including a water soluble copper compound and a copper complexing agent, formaldehyde and an alkaline compound to control the pH of said aqueous solution. The chemical reaction of copper deposition is expressed as follows:

$$Cu^{++}+2HCHO+4OH^{-} \rightarrow Cu+H_2+2H_2O+2HCO_2^{-} \quad 1.$$

The chemical reaction includes an oxidation reaction of formaldehyde by $OH^-$ and a reduction reaction of copper ion. The oxidation reaction of formaldehyde by $OH^-$ is a catalytic reaction due to Pt, Au, Ag, Pd and Cu. When a material having such a catalyzer adhered to a particular portion is immersed in the plating bath composition, the particular portion is covered with copper deposited under suitable reaction condition. Since the deposited copper itself acts as an useful catalyzer, the copper deposition reaction proceeds to increase the thickness of deposited copper film. However, the following side reaction occur in the plating bath;

$$2Cu^{++}+HCHO+5OOH^{-} \rightarrow Cu_2O+HCO_2^{-}+3H_2O \quad 2.$$

$$Cu_2O+H_2O \rightarrow Cu+Cu^{++}+2OH^{-} \quad 3.$$

As a result, $Cu_2O$ is deposited in the plating bath and is reduced to a metal copper. Both the deposition of $Cu_2O$ and the reduction of $Cu_2O$ accelerately decompose the plating bath. Therefore, the plating bath composition is quickly degraded and is wasted. In addition, the copper layer deposited by such method is rough, brittle and is not capable of withstanding the bending test set forth hereinafter.

There have been tried various methods to improve such drawbacks. One method is to suppress the reduction reaction of metal by adding an additive agent which has usually negative catalytic action. Such additive agent suppresses the decomposition reaction of equations (2) and (3) and simultaneously prevents the deposition of copper according to the reaction (1). Sometimes the continuous deposition of copper is impossible because of a complete stop of chemical reaction (1). Another method is to add a complexing agent for cuprous ions into a plating bath composition. The complexing agent makes the cuprous ions formed by the reaction (2) to be a cuprous complex and prevents the reaction (3). Accordingly, the plating bath is stable and does not get decomposed during its storage or plating. However, the complexing agent for cuprous ions are not always effective for improving the mechanical strength of deposited copper film, which is another drawback in the conventional electroless copper plating.

Therefore, an object of the present invention is to provide a method for electroless copper plating in which the deposited copper film is superior in brightness and mechanical strength.

The method for electroless copper plating according to the present invention comprises: providing an electroless copper plating bath composition which comprises 0.005 to 0.3 mole per liter of a water soluble copper compound, 0.005 to 0.6 mole per liter of a cupric complexing agent, 0.02 to 3.0 mole per liter of formaldehyde, 0.05 to 1000 milligram per liter of additive agent selected from the group consisting of 2,2'-dipyridyl, 2,9-dimethyl-1,10-phenanthroline and 2-(2-pyridyl)-benzimidazole, and alkaline compound to hold the pH of said aqueous solution 10.5 to 14 and immersing a material having catalytic action at the surface into said electroless copper plating bath composition kept at a temperature of 70° to 90° C whereby copper film with a high mechanical strength is deposited on said material.

An operable water soluble copper compound is copper sulfate, copper nitrate, copper chloride or copper acetate. An operable copper complexing agent is tartrate, citrate, ethylenediaminetetraacetate, or triethanolamine. Among these operable copper complexing agents, ethylenediaminetetraacetate is most favorable in accordance with the present invention. An operable alkaline compound is sodium hydroxide or sodium carbonate. The plating bath composition according to the invention is very stable and can be stored for a long time period at a room temperature without any degrading. In addition, the present bath composition can be used at the temperature ranging from 50° to 90° C without spontaneous decomposition and used as long as the copper ions in the composition completely expend. The more important feature of the present invention is to improve the mechanical strength of the copper metal film plated by using the present bath composition.

It has been discovered according to the present invention that a copper metal film having a high mechanical strength is obtained when it is plated with the present bath composition controlled in the amount of the additive agent and a plating temperature. Table 1 shows an amount of additive agent and a plating temperature operable for formation of copper metal film having a high mechanical strength.

Table 1

| Additive agent | Amount(mg/liter) | Plating temperature (° C) |
|---|---|---|
| 2,2'-dipyridyl | 50–1000 | 50–90 |
| | 0.01–50 | 60–90 |
| 2,9-dimethyl-1,10-phenanthroline | 100–1000 | 50–90 |
| | 30–100 | 60–90 |
| | 0.01–30 | 70–90 |
| 2-(2-pyridyl)-benzimidazole | 1–1000 | 60–90 |
| | 0.01–1.0 | 70–90 |

Furthermore, a higher mechanical strength which is measured by the bending test of more than two times is obtained by using an amount of additive agent and plating temperature as shown in Table 2.

Table 2

| Additive agent | Amount(mg/liter) | Plating temperature (° C) |
|---|---|---|
| 2,2'-dipyridyl | 0.05–1000 | 70–90 |
| 2,9-dimethyl-1-10- | 10–1000 | 70–90 |

Table 2-continued

| Additive agent | Amount(mg/liter) | Plating temperature (° C) |
|---|---|---|
| phenanthroline | | |
| 2-(2-pyridyl)-benzimidazole | 1–1000 | 70–90 |

It is known that 2,2′-dipyridyl is a complexing agent for a cupric and cuprous compounds, and that 2-(2-pyridyl)-benzimidazole and 2,9-dimethyl-1,10-phenanthroline are complexing agents for a cuprous compound. As stated above, a complexing agent for cuprous ions is useful for stabilization of electroless copper plating bath. Among various complexing agents for cuprous ions, 2-mercaptobenzothiazole, rhodanine derivatives, 2,2′-biquinoline, and phenanthroline derivatives are known to have an effect to stabilize the electroless copper plating bath composition. However, the copper metal film plated by using these complexing agents for cuprous ions is usually brittle and is not so ductile to overcome the repetition of a bending test. On the other hand, the copper metal film plated at the temperature of 50° to 90° C by using the complexing agents for cuprous ions specified in the present invention is ductile and can withstand the repetition of the bending test. The plating temperature is also as important as the complexing agent for cuprous ions, that is, the copper metal film plated at the temperature of lower than 50° C cannot overcome the repetition of the bending test even though the bath composition of the present invention is used. It is not certain why the electroless copper plating bath composition according to the present invention is stable and forms a copper metal film superior in the brightness and mechanical properties. Possible mechanisms are due to the control of reaction rate, suppression of hydrogen gas, and prevention of incorporation of a minor amount of hydrogen and cuprous compound with the formed copper metal film.

It has been known that the plating bath composition varies in the composition with plating time and is required to be renewed by adding necessary ingredients. The electroless copper plating bath composition according to the present invention can be easily and simply renewed during the operation.

A material made of a metal having a catalytic action for the chemical equation (1) is easily covered with a copper metal film when immersed into the electroless copper plating bath after removal of fatty film and corrosion film adhered to the surface thereof. A metal having a catalytic action for the reaction equation (1) is Au, Pt, Pd, Ag and Cu. A metal having no catalytic action can be also coated with a copper metal film when is provided with the catalytic agent adhered to the surface thereof. A non-metallic material such as organic resin, glass and ceramic material can be coated by the copper metal film by using the electroless copper plating composition according to the present invention in a per se well known method; prior to the copper plating, the non-metallic material is immersed, for example, in an aqueous solution of stanous chloride and palladium chloride.

EXAMPLE

A plate of epoxy resin is sandblasted at the surface so as to form a rough surface and cleaned by washing with water. The surface treated plate is immersed in an aqueous solution of 10% of $SnCl_2$ for one minute and subsequently, in an aqueous solution of 5% of $PdCl_2$ for one minute. After being washed with water, the plate is immersed in an electroless copper plating bath having a bath composition listed in Table 3, 4 and 5 for a time period during which the deposited copper metal film grows to 5 to 10 microns of thickness.

A metal copper film deposited is taken off from epoxy resin plate and formed into a foil having width of about 10 millimeters. The mechanical strength of the foil is evaluated by a number of bending test in which the foil is bended at a center line so that the bended part contacts with another part. Such test is repeated until the foil shows a cracking. Tables 3, 4 and 5 indicate a result of bending test carried out with a copper metal foil prepared by using various plating compositions at various temperatures. These examples show that copper metal films prepared from the bath composition having suitable amounts of the complexing agents for cuprous ions at the suitable bath temperatures stand the number of bending test more than 2. On the other hand, copper metal films prepared from the bath composition having no complexing agent for cuprous ions at the temperature of 30° to 90° C stand the bending test of less than 1, as shown in table 3.

Table 3

| Bath Composition | | | | | Bending Test | | | | | | |
|---|---|---|---|---|---|---|---|---|---|---|---|
| | | | | | Bath Temperature (° C) | | | | | | |
| $CuSO_4 \cdot 5H_2O$ (mole/liter) | E.D.T.A. (mole/liter) | HCHO (mole/liter) | pH | 2,2′-dipyridyl (milligram/liter) | 30 | 40 | 50 | 60 | 70 | 80 | 90 |
| 0.03 | 0.08 | 0.20 | 12.5 | 1000 | — | — | — | 5 | 10 | 8 | 7 |
| 0.03 | 0.08 | 0.20 | 12.5 | 500 | <1 | <1 | 2 | 4 | 10 | 8 | 8 |
| 0.10 | 0.15 | 0.20 | 12.5 | 100 | <1 | <1 | 3 | 4 | 8 | 9 | 5 |
| 0.05 | 0.10 | 0.20 | 12.5 | 50 | <1 | <1 | 2 | 7 | 7 | 8 | 5 |
| 0.03 | 0.05 | 0.20 | 12.5 | 50 | <1 | <1 | 2 | 5 | 7 | 8 | 8 |
| 0.03 | 0.05 | 0.10 | 12.0 | 10 | <1 | <1 | <1 | 3 | 8 | 8 | 7 |
| 0.03 | 0.05 | 0.10 | 12.3 | 1 | <1 | <1 | <1 | 3 | 9 | 7 | 5 |
| 0.03 | 0.05 | 0.10 | 12.0 | 0.05 | <1 | <1 | <1 | 2 | 6 | 3 | 3 |
| 0.03 | 0.05 | 0.10 | 12.5 | — | <1 | <1 | <1 | <1 | <1 | <1 | <1 |

Table 4

| Bath Composition | | | | | Bending Test | | | | | | |
|---|---|---|---|---|---|---|---|---|---|---|---|
| | | | | | Bath Temperature (° C) | | | | | | |
| $CuSO_4 \cdot 5H_2O$ (mole/liter) | E.D.T.A. (mole/liter) | HCHO (mole/liter) | pH | 2,9-dimethyl-1,10-phenanthroline (milligram/liter) | 30 | 40 | 50 | 60 | 70 | 80 | 90 |
| 0.03 | 0.08 | 0.20 | 12.5 | 1000 | <1 | <1 | 5 | 3 | 12 | 12 | 10 |

Table 4-continued

| Bath Composition | | | | | Bending Test | | | | | | |
|---|---|---|---|---|---|---|---|---|---|---|---|
| | | | | | Bath Temperature (° C) | | | | | | |
| $CuSO_4 .5H_2O$ (mole/liter) | E.D.T.A. (mole/liter) | HCHO (mole/liter) | pH | 2,9-dimethyl-1,10-phenanthroline (milligram/liter) | 30 | 40 | 50 | 60 | 70 | 80 | 90 |
| 0.03 | 0.08 | 0.20 | 12.5 | 500 | <1 | <1 | 2 | 3 | 13 | 10 | 10 |
| 0.10 | 0.15 | 0.20 | 12.5 | 100 | <1 | <1 | 2 | 3 | 9 | 12 | 12 |
| 0.05 | 0.10 | 0.20 | 12.5 | 50 | <1 | <1 | 1 | 4 | 10 | 8 | 10 |
| 0.03 | 0.05 | 0.20 | 12.5 | 30 | <1 | <1 | 1 | 3 | 5 | 10 | 5 |
| 0.03 | 0.05 | 0.10 | 12.0 | 10 | <1 | <1 | <1 | 1 | 3 | 3 | 2 |
| 0.03 | 0.05 | 0.10 | 12.0 | 1 | <1 | <1 | <1 | 1 | 2 | 2 | 1 |
| 0.03 | 0.05 | 0.10 | 12.0 | 0.05 | <1 | <1 | <1 | 1 | 3 | 2 | 1 |

Table 5

| Bath Composition | | | | | Bending Test | | | | | | |
|---|---|---|---|---|---|---|---|---|---|---|---|
| | | | | | Bath Temperature (° C) | | | | | | |
| $CuSO_4 .5H_2O$ (mole/liter) | E.D.T.A. (mole/liter) | HCHO (mole/liter) | pH | 2-(2-phyridyl)-benzimidazole (milligram/liter) | 30 | 40 | 50 | 60 | 70 | 80 | 90 |
| 0.003 | 0.08 | 0.20 | 12.5 | 1000 | <1 | <1 | <1 | 1 | 5 | 3 | 2 |
| 0.10 | 0.15 | 0.20 | 12.5 | 100 | <1 | <1 | 2 | 4 | 3 | 5 | 3 |
| 0.05 | 0.10 | 0.20 | 12.5 | 50 | <1 | <1 | <1 | 3 | 5 | 4 | 3 |
| 0.03 | 0.05 | 0.20 | 12.5 | 10 | <1 | <1 | <1 | 3 | 3 | 6 | 2 |
| 0.03 | 0.05 | 0.20 | 12.0 | 1 | <1 | <1 | <1 | 2 | 2 | 6 | 3 |
| 0.03 | 0.05 | 0.20 | 12.2 | 0.1 | <1 | <1 | <1 | <1 | 2 | 3 | 1 |
| 0.03 | 0.05 | 0.20 | 12.2 | 0.05 | <1 | <1 | <1 | <1 | 2 | 3 | 1 |

What we claim is:

1. A method for electroless copper plating comprising providing an electroless copper plating bath which comprises 0.005 to 0.3 mole per liter of a water soluble copper salt, 0.005 to 0.6 mole per liter of ethylenediaminetetraacetate as a complexing agent for cupric ions, 0.02 to 3.0 mole per liter of formaldehyde, 0.05 to 1000 milligrams per liter of 2,2′-dipyridyl and an alkaline compound to maintain the pH of said aqueous solution to between 10.5 and 14 and immersing a material having catalytic action at the surface into said electroless copper plating bath composition maintained at a temperature of 70° to 90° C whereby a copper film having a high mechanical strength is deposited on said material.

2. A method according to claim 1, wherein the water soluble copper salt is selected from the group consisting of copper sulfate, copper nitrate, copper chloride and copper acetate and the alkaline compound is a member selected from the group consisting of sodium hydroxide and sodium carbonate.

3. A method for electroless copper plating comprising providing an electroless copper plating bath which comprises 0.005 to 0.3 mole per liter of a water soluble copper salt, 0.005 to 0.6 mole per liter of ethylenediaminetetraacetate as a complexing agent for cupric ions, 0.02 to 3.0 mole per liter of formaldehyde, 10 to 1000 milligrams per liter of 2,9-dimethyl-1,10-phenanthroline and an alkaline compound to maintain the pH of said aqueous solution to between 10.5 and 14 and immersing a material having catalytic action at the surface into said electroless copper plating bath composition maintained at a temperature of 70° to 90° C whereby a copper film having a high mechanical strength is deposited on said material.

4. A method according to claim 3, wherein the water soluble copper salt is selected from the group consisting of copper sulfate, copper nitrate, copper chloride and copper acetate and the alkaline compound is a member selected from the group consisting of sodium hydroxide and sodium carbonate.

5. A method for electroless copper plating comprising providing an electroless copper plating bath which comprises 0.005 to 0.3 mole per liter of a water soluble copper salt, 0.005 to 0.6 mole per liter of ethylenediaminetetraacetate as a complexing agent for cupric ions, 0.02 to 3.0 mole per liter of formaldehyde, 1–1000 milligrams per liter of 2-(2-pyridyl)-benzimidazole and an alkaline compound to maintain the pH of said aqueous solution to between 10.5 and 14 and immersing a material having catalytic action at the surface into said electroless copper plating bath composition maintained at a temperature of 70° to 90° C whereby a copper film with a high mechanical strength is deposited on said material.

6. A method according to claim 5, wherein the water soluble copper salt is selected from the group consisting of copper sulfate, copper nitrate, copper chloride and copper acetate and the alkaline compound is a member selected from the group consisting of sodium hydroxide and sodium carbonate.

* * * * *